United States Patent [19]

Smith

[11] 3,984,027

[45] Oct. 5, 1976

[54] FOOD SERVICE PACKAGE

[75] Inventor: G. Kenneth Smith, Waterville, Ohio

[73] Assignee: Owens-Illinois, Inc., Toledo, Ohio

[22] Filed: Dec. 15, 1975

[21] Appl. No.: 640,658

[52] U.S. Cl. ..... 220/306; 220/3.1; 229/43; 229/2.5 R; 150/.5

[51] Int. Cl.[2] ..... B65D 43/02

[58] Field of Search ..... 220/306, 3.1, 307, 4 R, 220/4 B; 229/43, 2.5; 150/.5

[56] References Cited

UNITED STATES PATENTS

| | | | |
|---|---|---|---|
| 3,902,540 | 9/1975 | Commisso | 229/2.5 X |
| 3,935,962 | 2/1976 | Schubert et al. | 220/306 |

*Primary Examiner*—George T. Hall

*Attorney, Agent, or Firm*—David R. Birchall; Edward J. Holler; Steve M. McLary

[57] ABSTRACT

An improved two piece food package. The package includes lid and dish members. The lid has formed in its perimeter three slots, two on one side and a single slot on the opposite side. The dish member has three locking tabs designed to engage the slots in the lid to thereby hold the two members together as a unit package. Under the single tab is formed a locking lug. The locking lug extends outward far enough to interfere with a portion of the lid when the lid and dish are assembled. This interference causes the dish sidewall to bow, creating a lock of the dish sidewall into corners of the lid.

Figure 1:
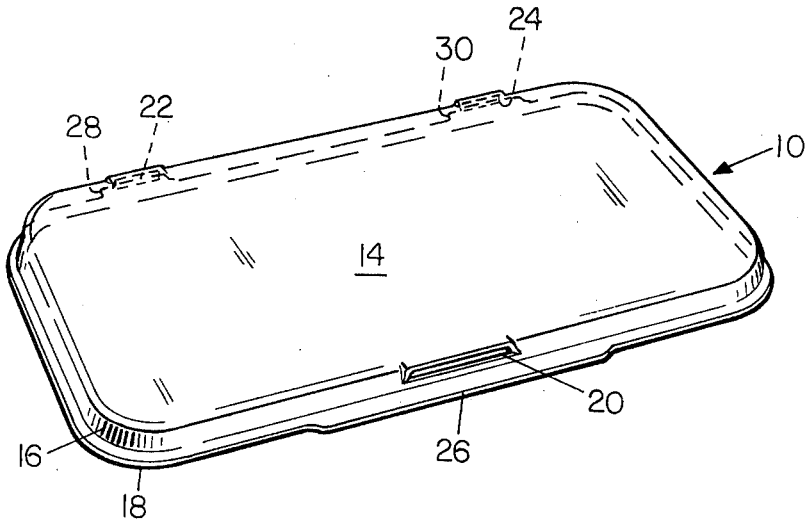
Figure 2:
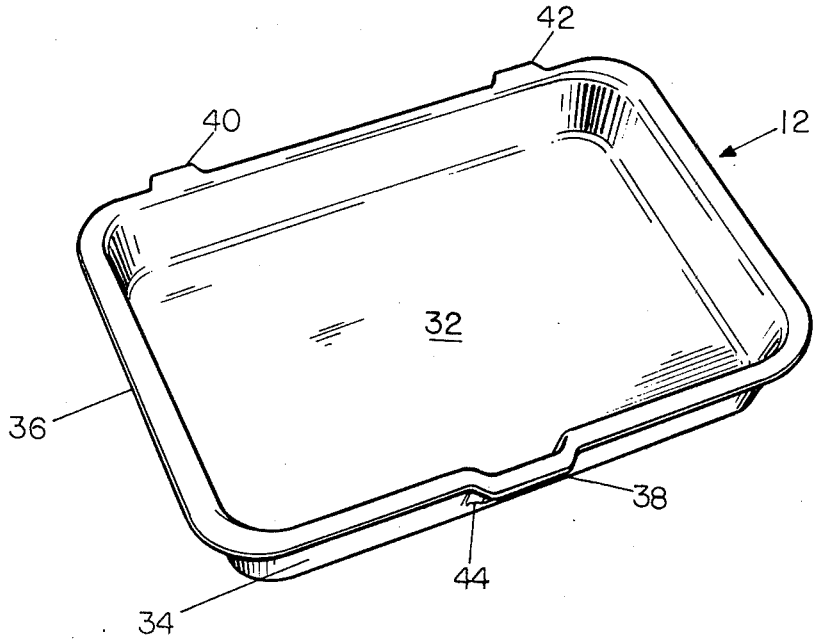
Figure 3:
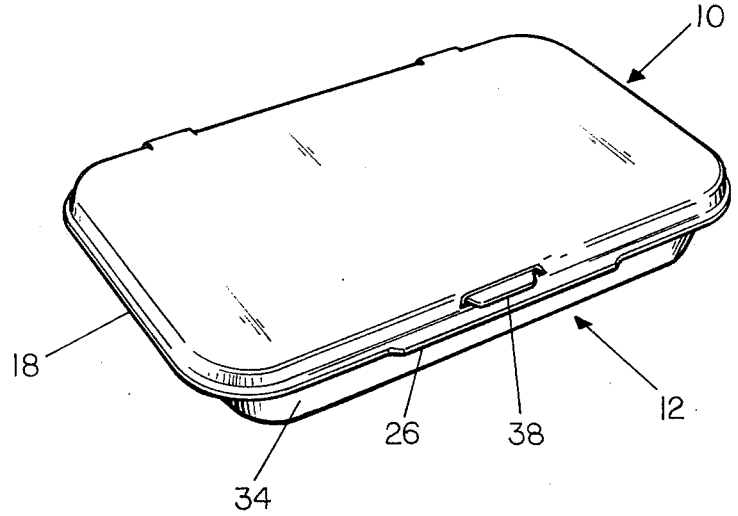
Figure 6:
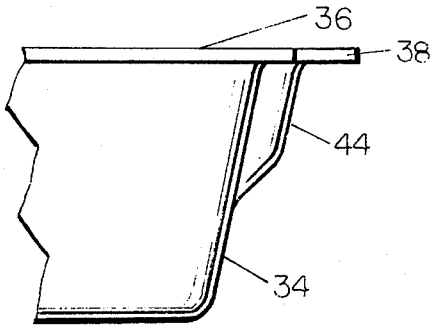
Figure 7:
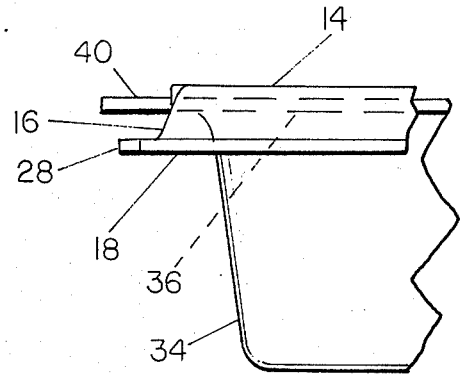
Figure 8:
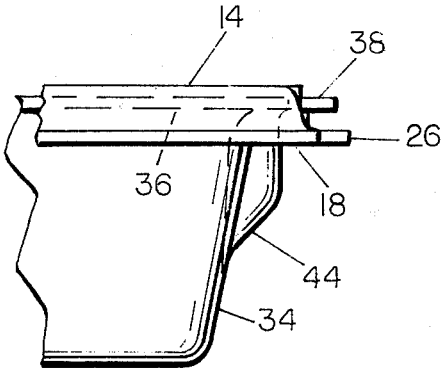
Figure 5:
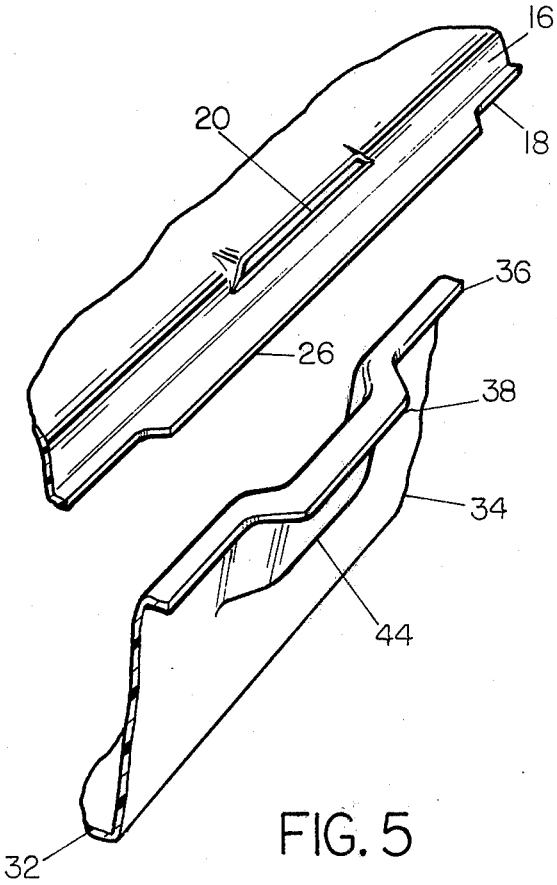
Figure 4:
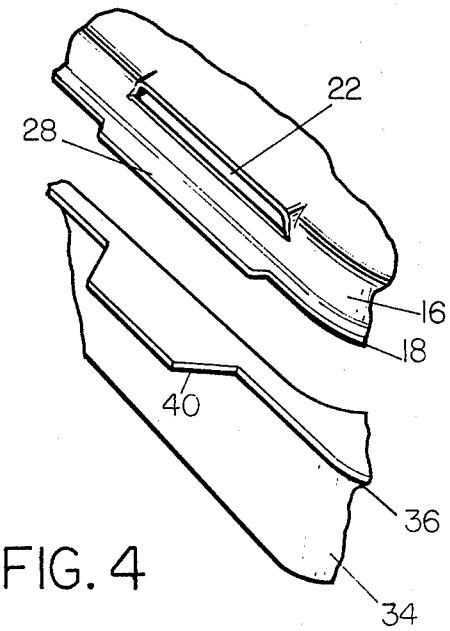
Figure 9:
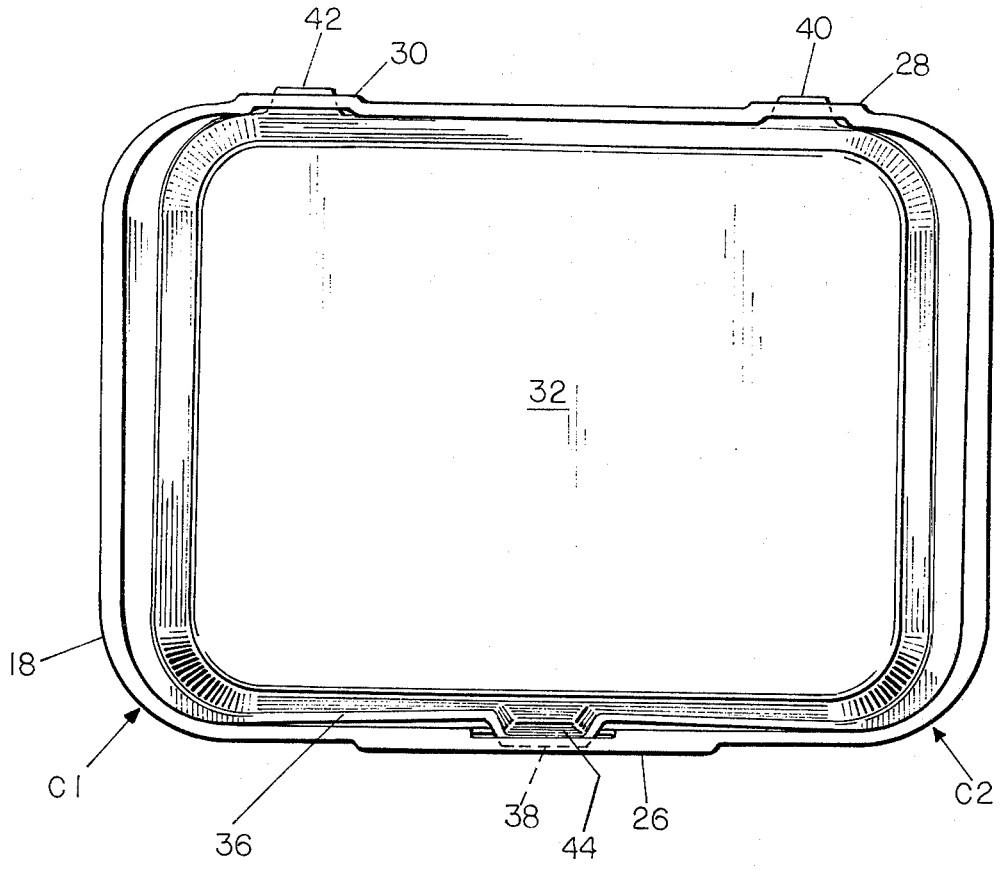

5 Claims, 9 Drawing Figures